United States Patent [19]

Kline

[11] 3,993,021

[45] Nov. 23, 1976

[54] TRANSFER DEVICE

[75] Inventor: Robert J. Kline, Stillwater, Minn.

[73] Assignee: Minnesota Mining and Manufacturing Company, St. Paul, Minn.

[22] Filed: Apr. 4, 1975

[21] Appl. No.: 564,999

Related U.S. Application Data

[62] Division of Ser. No. 368,108, June 8, 1973, Pat. No. 3,900,591.

[52] U.S. Cl. ..... 118/651; 355/3 R

[51] Int. Cl.[2] ..... G03G 15/16

[58] Field of Search ..... 118/637; 427/16, 24; 96/1.4; 355/3 TR

[56] References Cited

UNITED STATES PATENTS

| | | | |
|---|---|---|---|
| 3,633,543 | 1/1972 | Pitasi et al. | 118/637 |
| 3,647,292 | 3/1972 | Weikel, Jr. | 118/637 |
| 3,687,539 | 8/1972 | Furuichi | 118/637 |
| 3,691,993 | 9/1972 | Krause et al. | 118/637 |
| 3,693,181 | 9/1972 | Marshall et al. | 346/74 ES |
| 3,751,156 | 8/1973 | Szostak et al. | 118/637 |
| 3,832,055 | 8/1974 | Hamaker | 96/1.4 |
| 3,900,591 | 8/1975 | Kline | 118/637 |

*Primary Examiner*—Mervin Stein
*Assistant Examiner*—Douglas Salser
*Attorney, Agent, or Firm*—Alexander, Sell, Steldt & DeLaHunt

[57] ABSTRACT

A transfer device especially adapted for transferring electrographic toner powder images to plain paper, the transfer device including an apertured, electrically conductive support member overlying which is a surface layer in the form of a pile fabric having a multiplicity of electrically conductive fibrous loops, and vacuum means cooperating with the apertures for drawing copy paper into intimate clinging engagement with the surface layer.

4 Claims, 2 Drawing Figures

TRANSFER DEVICE

Figure 1:
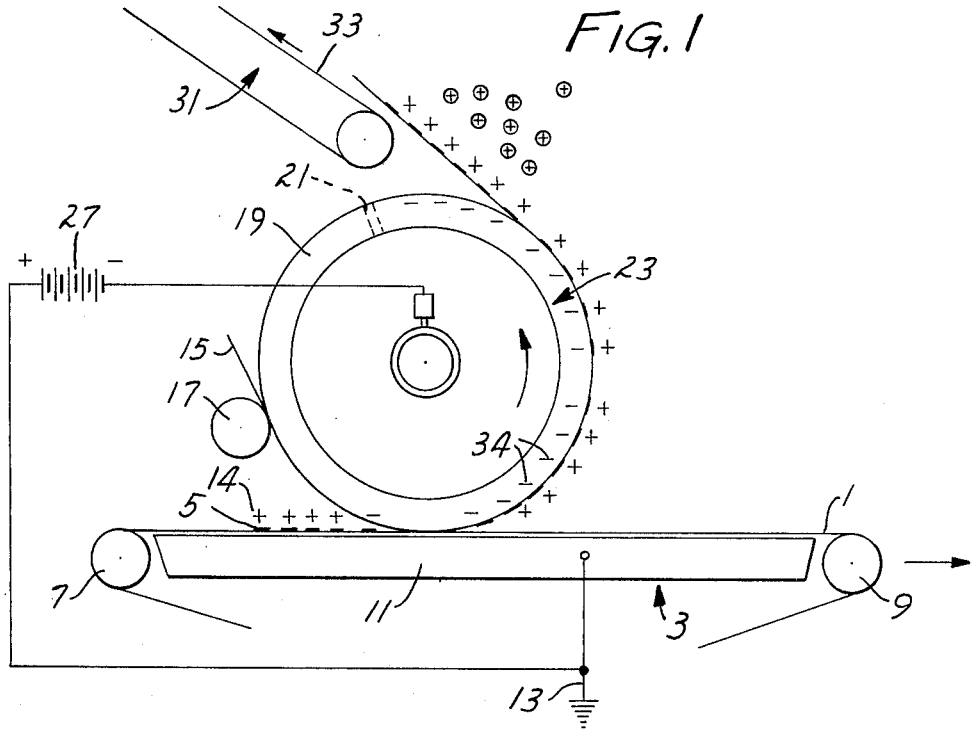

This is a division of application Ser. No. 368,108 filed June 8, 1973, now U.S. Pat. No. 3,900,591.

This invention relates to an apparatus and process for transferring particles in imagewise fashion from one surface to another. The invention is particularly suited for transferring electrographically developed toner powder images from an electrographic surface to plain paper with retention of the pattern of the developed image.

Previous methods of transferring developed images to plain copy papers include the use of corona wires, conductive brushes, and conductive rollers. Image transfers made using the corona method are subject to serious nonuniformity problems if vibration of the corona wire or powder buildup on the wire occurs, as well as being very sensitive to changes in temperature, relative humidity, the amount of powder on the developed images, and changes in the electrical characteristics of the copy paper used. Frequent cleaning and adjustment of the corona is required to maintain consistent quality and density of the transferred copy under the wide variety of environmental conditions and many types of copy paper to which the copying machine is or may be exposed.

The conductive brush type transfer as disclosed in U.S. Pat. No. 3,691,993 is stated to overcome some disadvantages of the corona transfer technique, but itself has the disadvantages of causing copy registration problems, scuffing or abrasion of the photoconductor surface, as well as non-uniformly transferred image where the brush fibers separate or bunch together. In the brush transfer, toner particles which had been electrostatically charged are transferred from an image surface to a web of transfer material by means of a brush. The brush comprises a plurality of unitary, electrically conductive fibers which extend substantially outward from the base. The tips of the fibers move the web of transfer material into abutting contact with the image surface bearing the electrostatically charged toner particles under the influence of an electrical potential difference which causes transfer. In the preferred embodiment, the brush tips move at a higher velocity than that of the web-image surface sandwich while in the transfer nip.

In another transfer system not involving electrostatically charged toner particles, a smooth conductive back-up roller is provided in place of the brush. The toner powder image undergoes a blasting effect at the time the web of transfer material is separated from the roller surface. To minimize this blasting, papers are employed having a special sizing. This expedient is not entirely satisfactory, however, since special plain papers are required whereas the copying market, especially the high volume copying market, demands that conventional plain paper from a variety of sources be usable.

In the present invention, a transfer device is provided comprising an electrically conductive support member having apertures therein overlying which is a surface layer in the form of a pile fabric having a multiplicity of electrically conductive fibrous loops adapted to make intimate electrically conductive contact with a web or sheet of copy material, and vacuum means communicating with said apertures for drawing said web into clinging engagement with said fibrous loops whereby said web is stationary with respect to said transfer device when said transfer device is moving. This device is adapted to be connected to a source of electrical potential for purposes to be explained hereinafter.

In another embodiment of the invention, a process is provided comprising:

1. providing contact between a first surface of a web and a transfer member, said transfer member comprising an apertured, electrically conductive support member and a surface layer in the form of a pile fabric having a multiplicity of electrically conductive fibrous loops,
2. vacuum drawing said first surface of said web into intimate contact with said electrically conductive loops whereby said web is stationary relative to said transfer member,
3. contacting a second surface of said web opposing said first surface of said web with a carrier surface bearing particles disposed in a predetermined pattern thereon, said particles having electrical charges of one polarity associated therewith,
4. providing an electrical potential difference between said transfer member and said carrier surface whereby said web acquires an electrical charge of opposite polarity to said one polarity, and
5. separating said web from said carrier surface whereby said particles transfer to said second surface of said web with retention of said predetermined pattern.

Figure 2:
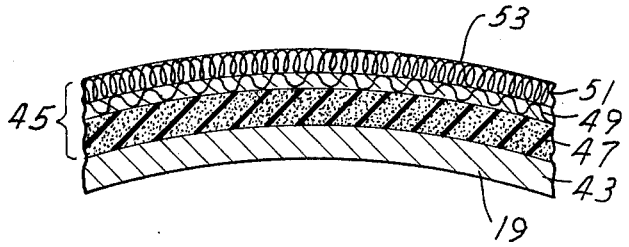

Reference is now made to the attached drawings wherein:

FIG. 1 is a schematic view illustrating the transfer process of this invention; and FIG. 2 is a cross-sectional view in elevation of a transfer device of this invention.

Referring to FIG. 1, a carrier member 1 in the form of a web mounted on moveable carriage 3 carries a plurality of particles 5. Carrier member 1, mounted over guide rolls 7 and 9, is connected at one end to a supply roll (not shown) and at the other end to a take-up roll (not shown). The carriage 3, which has an electrically conductive base 11 connected to ground 13, rolls on a track not shown and in FIG. 1 is shown as moving from left to right across the page. Particles 5 have previously been deposited on the surface of member 1 by any means of deposition. The particles 5 have associated therewith an electrical charge 14. In this embodiment, the electrical charge is positive in polarity. It is to be understood that where a charge of one polarity is shown, a charge of the opposite polarity could be employed as well. The particles 5 are located on the surface of member 1 in accordance with a predetermined pattern.

Making contact with the surface of member 1 bearing particles 5 is a sheet 15 which is fed past nip roll 17 into contact with drum 19. Drum 19 contains apertures 21 which are operatively associated with a vacuum source not shown. This source produces a suction from the outside of drum 19 towards the inside in the direction of arrow 23. This suction thus exerts a force on the leading edge of the sheet 15 which draws it into intimate, clinging engagement with drum 19. Thus, sheet 15 is maintained stationary with respect to the drum 19. The drum 19 rotates in a counterclockwise direction at a speed essentially the same as the speed of carriage 3. In the preferred embodiment, drum 19 is indexed to provide registration between the apertures 21 and the leading edge of the sheet 15. The term sheet as used herein includes films or sheets of any length. In copying and duplicating processes paper in a continuous roll form or separate sheets is conventionally employed.

Drum 19 and carriage 3, including base 11, are connected to a source of electrical potential 27; drum 19 being connected to the pole having a polarity opposite the polarity of the charge associated with the particles 5.

At the appropriate time, drum 19 drops into contact with the carriage 3. As drum 19 rotates with its surface speed synchronized with that of carriage 3, the toner particles 5 on the carrier member 1 are transferred with retention of their relative positions to the surface of sheet 15 by impressing a voltage on the drum 19.

As the leading edge of the sheet 15 (still held by vacuum) nears the lower end of a conveyor 31, sheet 15 is blown off the drum 19 by a positive pressure applied at that point. A vacuum applied to the moving conveyor belt 33 allows the sheet to be picked up and carried to further processing stations such as a fuser, cutter, etc. and finally out of the machine.

The most serious problem with respect to image degradation occurs when sheet 15 leaves the drum 19. The particles 5 which make up the transferred images are held in place by oppositely charged mirror images 34 as long as the sheet 15 is in contact with the drum 19. As soon as the sheet 15 begins to separate from the drum 19, however, the electrical charges 34 either remain with the drum 19 or move to the backside of the sheet 15. If these charges 34 remain predominately on the drum 19, insufficient charges are left on the sheet 15 to bind the particles 5 in the position, and many of them are blown off the sheet by their mutually repelling charges into the surrounding air and onto adjacent machine surfaces. The copy then exhibits the low density blasted image mentioned earlier. If the drum is able to force a sufficient number of mirror image charges 34 to remain with the sheet, however, the blasting is eliminated and the image remains intact. It is to be understood that sheet 15 may be provided in any web form whether pre-cut or in roll form.

Sufficient contact pressure between the drum 19 and the base 11 must be applied to immobilize the powder image in the nip area and prevent lateral movement of the powder particles into the adjacent background areas. Pressures of about 140 to 560 gm./cm.$^2$ have proved effective.

FIG. 2 depicts a preferred embodiment of the transfer device of this invention. The transfer device here shown as a cylindrical drum 19 includes an electrically conductive cylindrical member 43 which provides support for a covering 45 adhered thereto. Covering 45 includes a backing 47, preferably nonstretchable and dimensionally stable, a resilient layer 49 adherably bonded to the backing 47, and an electrically conductive surface layer 51 comprising a plurality of fibrous loops 53. Preferably, surface layer 51 is an electrically conductive pile fabric having a multiplicity of loops. The covering 45 may be used to form a replaceable blanket which can be wrapped around the cylindrical member 43 and fastened in place by suitable means such as double-coated pressure-sensitive adhesive tape. The resilient layer, which may be of a soft rubber, foam or sponge material, acts as a cushion between the cylindrical member or other support 43 and the surface layer 51 to ensure uniform contact pressure between the transfer device and the electrographic member 1.

As noted above, the particles 5 may be initially deposited on a carrier surface by any means, electrographic or otherwise. An electrographic process which may be employed to obtain a pattern of particles on a carrier surface is the process involving development of a latent conductivity pattern (Shely, U.S. Pat. No. 3,563,734, incorporated herein by reference). A preferred toner is that described in Nelson, U.S. Pat. No. 3,639,245 incorporated herein by reference. These particles have a relatively resistive core and a relatively electrically conductive periphery and are magnetically attractable. The conductivity of these toner particles ranges from about $10^4$ to about $10^{11}$ mho/cm. at 100 volts per cm. d.c. field.

The carrier surface may be composed of a variety of materials. Suitable materials include those which are electrically insulating at least in the absence of activating radiation, e.g., polymeric films, such as polyesters, and layers of organic and inorganic photoconductors either as a single homogeneous layer, such as selenium, arsenic selenide or the like, or as blends of a photoconductor, such as zinc oxide, titanium dioxide, cadmium sulfide, or polyvinyl carbazole, and an insulating binder. Preferably, the carrier surface is an insulating material having a conductivity in the absence of activating radiation ranging from $10^{-11}$ to about $10^{-14}$ mho/cm. The carrier surface is provided with an electrically conductive backing either integral with or separate from the carrier surface. This backing is electrically connected to one terminal of the voltage source and preferably is also connected to ground. Typical backings include metal platens, drums, rollers, as well as metallized coatings and resins loaded with conductive particles.

The preferred covering for the transfer member is comprised of a polyester backing, on the order of 125 microns thick, to which is adhesively bonded a urethane foam, typically 3 to 7 millimeters thick, to which, in turn, is adhesively bonded an electrically conductive fuzz fabric, preferably a metal impregnated natural or synthetic fiber pile fabric. A silver impregnated polyamide pile fabric is most preferred. Such a material, described in U.S. Pat. No. 3,693,181, has a myriad of soft loops or piles extending from a fabric-like base. The piles have good recovery characteristics and provide the resilience required for mechanical and electrical engagements. A preferred commercially available pile fabric is available under the tradename Tecknit Confuzz Fabric Cloth. This cloth has a weight of about 142 grams per square meter, a loop tricot fabric construction, is impregnated with about 30% by weight silver, has a surface resistivity of 2 ohms per square and surface-to-surface resistivity of 0.016 ohms per square centimeter.

The preferred pile fabric should have a loop density ranging from 300 to 3,000 per square centimeter with each loop having a fiber diameter of 5 to 30 microns. The pile should extend above the woven backing a distance of 0.050 to 0.160 centimeters. Volume resistivity of the material (surface-to-surface) should be less than 5,500 ohms per square centimeter, although best results have been obtained with the most conductive fabric. Other metals than silver (such as nickel, copper, aluminum, etc.) can be used to make the fibers conductive, but silver is preferred because of its anti-corrosive properties and its high electrical conductivity.

Acceptable transfers of particles have been made over transfer speeds ranging from 12 to 76 centimeters/second, although the faster web speeds generally produce higher resolution copies. Optimum transfer results have been obtained with most plain copy papers where the transfer device has been held at a d.c. potential about 750 volts opposite that on the carrier surface. A minimum potential difference of at least 400 volts should be employed. For copiers operating in accordance with the process described in Shely, U.S. Pat. No. 3,563,734, a potential of −200 volts produces the best results for a wide variety of plain papers. The conductive nylon pile fabric permits higher quality copies to be made on such a machine over relative humidities ranging from 20 to 80 percent with most plain papers tested.

A wide variety of copy papers have been tested with little or no evidence of the blasting mentioned earlier. Very resistive-type papers ($2.21 \times 10^{12}$ ohm-cm) as well as more conductive papers ($1.21 \times 10^{8}$ ohm-cm) and papers which are constructed with a resistive surface on one side and a conductive surface on the other have been used successfully. It is to be understood that where the electrical characteristics of the papers vary widely, an adjustment in transfer roll potential may be needed to obtain the desired image density on the transferred copy.

EXAMPLE 1

Employing a device as depicted in FIG. 1, an image is developed on an electrographic member in accordance with the process described in Shely, U.S. Pat. No. 3,563,734. The carrier surface is photoconductive titanium dioxide disposed in an insulating resin binder underlying which is a polyester film which in turn is provided with a vapor coating of aluminum. The potential applied to the developer roll is +800 volts d.c. The toner is a powder having a resistive core and an electrically conductive surface as described in Nelson, U.S. Pat. No. 3,639,245. After development, the photoconductive carrier surface is at a surface potential of +550 to +600 volts. The transfer material is a sheet of plain bond paper (20 pound weight) having a resistivity of $7.2 \times 10^{11}$ ohm-cm moving at a surface speed of about 56 cm./sec. The transfer roll is of the construction depicted in FIG. 2 having an aluminum roll 11.25 cm. in diameter covered with, respectively, a polyester film 0.010 cm. thick, a layer of urethane foam 0.31 cm. thick, and silver impregnated nylon pile fabric cloth available under the tradename Tecknit Confuzz Fabric Cloth.

The leading edge of the paper is fed into contact with the transfer roll at which time the paper is subjected to a vacuum which draws the paper into intimate clinging contact with the pile cloth. As the paper passes into contact with the carrier surface bearing the toner powder developed image, a negative 200 volts direct current potential is applied. The toner powder is thereby attracted and transferred imagewise to the paper sheet.

Due to the force exerted by the vacuum, the paper or other copy sheet is pushed against the loops of the pile fabric. Unlike the brush described in U.S. Pat. No. 3,691,993, the copy sheet is not moved by the loop piles but rather is moved or driven together with the transfer roll itself to which it is releasably adhered by the vacuum. The paper sheet, adhered to the transfer roll by the vacuum at its leading edge, then moves away from the nip between the carrier surface and the transfer roll toward the lower end of the conveyor. At the appropriate time, the transfer roll vacuum is released and a force pressure applied which lifts the paper away from the transfer member and permits it to be picked up by the conveyor and carried to the fuser. The force is preferably in the form of a positive pressure exerted by a gas, generally air, which is directed opposite to the force exerted by the vacuum holding the web on the transfer member surface. The magnitude of the force providing the positive pressure should be sufficient to lift the web off of the transfer member.

In addition to the preferred embodiment depicted in FIG. 2, other transfer rolls may be employed wherein the pile fabric provides a surface covering for an electrically conductive substrate. For example, a non-resilient, electrically conductive substrate such as a metal core may be covered with the pile fabric having a plurality of fibrous loops 53. The pile fabric may be in direct contact with the surface of the non-resilient conductive substrate or there may be a resilient, electrically conductive layer interposed between the pile fabric and the non-resilient substrate. An exemplary resilient conductive material is silicone rubber filled with conductive particles sufficient to provide the requisite conductivity.

What is claimed is:

1. An apparatus comprising an electrically conductive support member having apertures therein overlying which is a surface layer in the form of a pile fabric having a multiplicity of electrically conductive fibrous loops adapted to make intimate electrically conductive contact with a web of copy material, and vacuum means communicating with said apertures for drawing said web into clinging engagement with said fibrous loops.

2. The apparatus of claim 1 wherein a resilient layer is interposed between said surface layer and said conductive support member.

3. The apparatus of claim 1 wherein said pile fabric comprises a multiplicity of silver impregnated polyamide fibrous loops.

4. An apparatus comprising an electrically conductive support member having apertures therein overlying which is a surface layer in the form of a pile fabric having a multiplicity of electrically conductive fibrous loops adapted to make intimate electrically conductive contact with a web of copy material, and vacuum means communicating with said apertures for drawing said web into clinging engagement with said fibrous loops, and means operatively connected to said support member to apply an electrical potential thereto.

* * * * *